US005519280A

United States Patent [19]

Shon et al.

[11] Patent Number: 5,519,280

[45] Date of Patent: May 21, 1996

[54] OXIDE CATHODE

[75] Inventors: Kyung-cheon Shon, Suwon; Jong-seo Choi, Anyang; Kwi-seok Choi; Gyu-nam Ju, both of Seoul; Sang-won Lee, Kunpo, all of Rep. of Korea

[73] Assignee: Samsung Display Devices Co., Ltd., Kyungki, Rep. of Korea

[21] Appl. No.: 216,019

[22] Filed: Mar. 21, 1994

[30] Foreign Application Priority Data

Aug. 24, 1993 [KR] Rep. of Korea ..... 93-16400

[51] Int. Cl.[6] ..... H01J 1/14

[52] U.S. Cl. ..... 313/346 R

[58] Field of Search ..... 313/346 R, 346 DC, 313/270, 310, 337

[56] References Cited

U.S. PATENT DOCUMENTS

| | | | |
|---|---|---|---|
| 5,122,707 | 1/1992 | Nakanishi et al. | 313/346 R |
| 5,146,131 | 9/1992 | Derks | 313/346 R |
| 5,216,320 | 6/1993 | Koizumi et al. | 313/346 R |
| 5,347,194 | 9/1994 | Derks | 313/346 R |

*Primary Examiner*—Sandra L. O'Shea
*Assistant Examiner*—Ashok Patel
*Attorney, Agent, or Firm*—Leydig, Voit & Mayer

[57] ABSTRACT

An oxide cathode is provided including an electron emissive material layer including barium, a metal base, a sleeve and a heater, wherein the electron emissive material layer further includes 0.1 to 20 wt. % of tin or a tin compound, based on the total amount of the electron emissive material, and indium or an indium compound.

13 Claims, 1 Drawing Sheet

OXIDE CATHODE

BACKGROUND OF THE INVENTION

The present invention relates to an oxide cathode, and more particularly, to an oxide cathode having improved electron emission characteristics and a longer lifetime.

The schematic structure of an oxide cathode will be explained referring to the attached FIG. 1.

The oxide cathode is provided with a circular tube type sleeve 2 which supports a cap-type metal base 1 in which nickel (Ni) is contained as a main component and small amounts of silicon (Si), magnesium (Mg), etc. are contained as a reducing agent and which houses a heater 3 for heating the cathode, and an electron emissive material layer 4 which is coated and formed on the metal base 1 containing barium (Ba) as a main component and acting as an electron emission source during cathode operation. That is, the oxide cathode is manufactured by closing up an end of a hollow, circular tube type sleeve with a metal base, inserting a heater in the sleeve for heating the cathode, and forming an electron emissive material layer of a mixture of two, three or more alkaline earth compounds on the surface of the metal base.

The electron emissive material layer of the oxide cathode is manufactured as follows.

First, complex carbonate particles of alkaline earth compounds containing barium are dispersed in an organic solvent containing binder and then the thus obtained dispersion is coated on a metal base such as nickel (Ni), platinum (Pt) containing reducing agents by a spraying or electrodeposition method. Thereafter, the coated layer is thermally decomposed to a complex oxide of alkaline earth compounds and aged to an electron emittable state to produce free barium through the reaction of the oxide with reducing agents contained in the metal base.

The electron emissive material layer which emits thermoelectrons is formed on the metal base as an oxide layer of an alkaline earth metal. As for the alkaline earth metal oxides, initially, oxides containing barium were employed. However, two-component oxides with strontium or three-component oxides with strontium and calcium are now widely employed as the homogeneous mixture, as the two- and three-component oxides are known to have good characteristics. These alkaline earth metal oxides absorb carbon dioxide or moisture from the air and react with them to give alkaline earth metal carbonates or hydroxides. That is, the oxides are unstable in an ambient, atmosphere, so alkaline earth metal salts (for example carbonate) of two- or three-component mixture-type which are stable in an ambient atmosphere are used. A dispersion of the metal salts in water or in an organic solvent is sprayed, electrodeposited or coated on the metal base to form a layer and then the metal salts are decomposed to form an oxide layer by the heater installed inside in a vacuum while removing gases using a vacuum pump.

The cathode having the electron emissive material layer is assembled in an electron tube, and heated to about 1000° C. by the heater during an evacuating process to make a vacuum. At this time, the metal salts, for example barium carbonate, decomposes to barium oxide as follows.

$$BaCO_3 \rightarrow BaO + CO_2\uparrow \quad (1)$$

The thus-obtained barium oxide is reduced by the reducing agents such as silicon and magnesium at the interface with the metal base during cathode operation as follows.

$$BaO + Mg \rightarrow MgO + Ba\uparrow \quad (2)$$

$$4BaO + Si \rightarrow Ba_2SiO_4 + 2Ba\uparrow \quad (3)$$

The produced free barium contributes to the electron emission. At this point, compounds such as MgO and $Ba_2SiO_4$ are produced at the interface of the electron emissive material layer and metal base as described in formulae (2) and (3). The product accumulates and forms a barrier, (a so-called "interlayer") at the interface, and this barrier interrupts diffusion of Mg or Si and makes the free barium production difficult. Therefore, this interlayer contributes to the shortening of the cathode lifetime and other undesirable results. Moreover, this interlayer has high resistance, and current density is limited because the interlayer disturbs the electron emission current flow.

The oxide cathode is widely used as an electron emission source for an electron tube since the manufacture thereof is easy and the characteristics thereof are good. However, the large and fine electron tubes require enhanced characteristics of electron emission and a longer lifetime. Accordingly, research to improve operation current density of the oxide cathode and lengthen the lifetime are continuously carried out.

Among the various factors which determine the lifetime of a cathode, the reduction of the barium content accompanied by the cathode operation or the interlayer growth as described above act as important factors. Hence, research for improving the cathode lifetime as well as electron emission ability by changing electron emission components or including specific compounds therein have been carried out.

Japanese Patent Laid-open sho 63-254635 discloses that the lifetime of a cathode manufactured by including indium compounds such as indium carbonate, indium oxide, indium hydroxide, and organic compounds of indium in a three-component carbonate can be enhanced about 1.5 times with respect to the cathode manufactured by employing a three-component carbonate at $0.5A/cm^2$.

However, the above-mentioned cathode has certain drawbacks in that the time required for aging is at least twice that required in the conventional cathode, and the initial characteristic is rather lower than that of the conventional cathode.

SUMMARY OF THE INVENTION

An object of the present invention considering the drawbacks of the conventional oxide cathode is to provide an oxide cathode which has a longer lifetime and improved electron emission characteristics.

The object of the present invention is accomplished by an oxide cathode comprising an electron emissive material layer including barium, a metal base, a sleeve and a heater, characterized in that the electron emissive material layer further comprises about 0.1 to about 20 wt % of tin or tin compound based on the total amount of the electron emissive material.

Indium or an indium compound is preferably included in the electron emissive material layer in an amount of about 0.1 to about 20 wt %, based on the total amount of electron emissive material, this amount being independent of the amount of tin or tin compound used. At this time, a complex compound of tin and indium, such as indium-tin oxide (ITO), or an alloy of tin and indium could be included. More preferably, a mixture of tin compound and indium compound is employed. The preferred complex compound of tin and indium, ITO, which exhibits a high electrical conductivity believed to cause acceleration of electron emission, may be formed from various proportions of $In_2O_3$ and $SnO_2$. Preferably the ITO employed is formed from about 95% $In_2O_3$ and about 5% $SnO_2$.

DETAILED DESCRIPTION OF THE INVENTION

Figure 1:
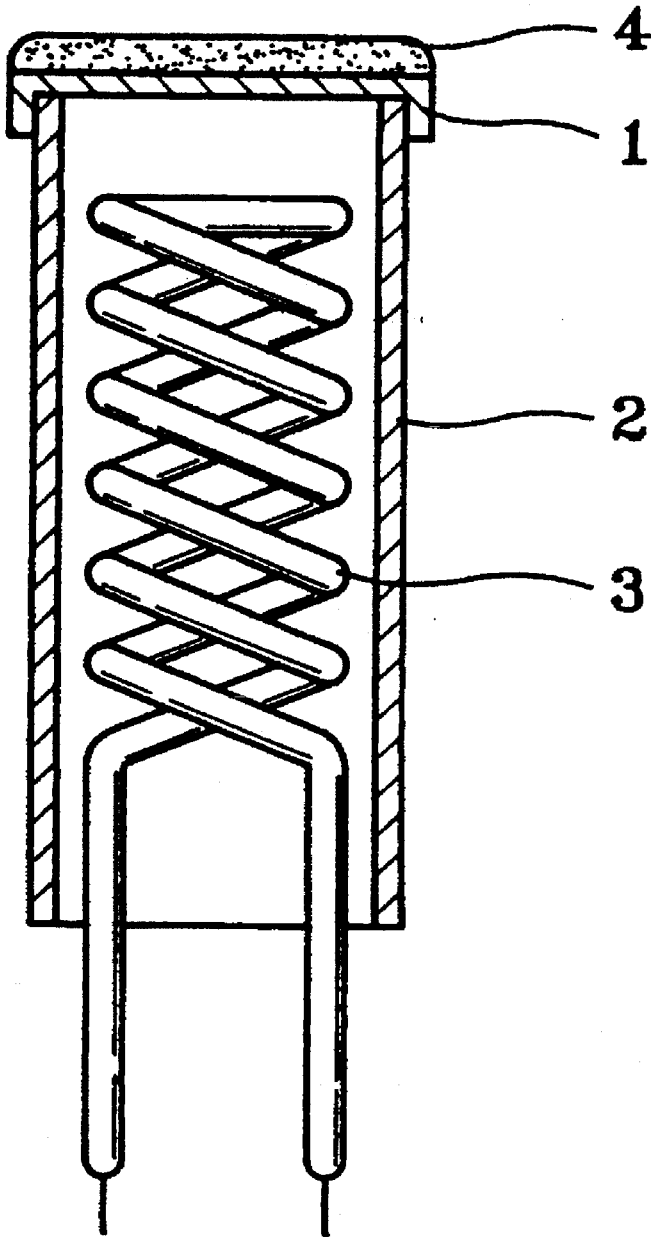
FIG. 1 is a cross-sectional view of an oxide cathode.

The method for manufacturing the oxide of the present invention will be described in detail below.

First, water-soluble salts of barium, calcium, strontium (for example, nitrates, chlorides, etc.) were dissolved in water and carbonates and/or bicarbonates such as $Na_2CO_3$ and $(NH_4)_2CO_3$, $NH_4HCO_3$ as a depositing agent were added thereto to prepare a carbonate, $(Ba,Sr,Ca)CO_3$.

The alkaline earth complex carbonate containing barium was dispersed in an organic solvent containing a binder. Then, 0.1 to 20 wt % of tin or tin compound, based on the total amount of the solid materials, was added and mixed to prepare a dispersion. On the surface of a metal base containing reducing agents, the thus-obtained dispersion was coated by a spray method, electrodeposition method, etc. and dried to form a coating layer. Then, the alkaline earth complex carbonate was changed to an alkaline earth complex oxide by thermal decomposition in a vacuum. Next, aging to produce free barium from the reaction with the reducing agents in the metal base gave an oxide cathode which can emit electrons.

To include tin in the electron emissive material layer, tin or tin compounds themselves can be added to the electron emissive material as described above, or the tin or tin compound can be co-precipitated during manufacturing the carbonate. The effects are the same, so the method is not especially limited. A tin compound selected from the group consisting of tin carbonate, tin oxide, tin hydroxide and an organic compound of tin is preferably used. The lifetime of the cathode is lengthened through including indium, besides the tin, in the electron emissive material layer.

The oxide cathode manufactured by including tin as in the present invention needs a shorter aging time than that manufactured by including only indium in the electron emissive material layer, and shows similar initial characteristics as in the conventional oxide cathode having an electron emissive material layer made of carbonate.

The above-described effects could be obtained due to the following reasons. The tin included in the electron emissive material layer reacts with barium produced during an evacuating and aging process for cathode manufacture to form a barium/tin compound. The produced barium/tin compound is useful for the electron emission and since barium is provided from the compound stably and slowly, the reduction in electron emission characteristic as the cathode operation proceeds is compensated and very stable electron emission characteristics are imparted.

Since barium reacts with tin compound before reacting with the reducing agents in the metal base, to produce a barium/tin compound, it is considered that the interlayer formation is prohibited. Ultimately, this has positive affects on the cathode and imparts good characteristics for a long time.

In conclusion, the oxide cathode of the present invention is manufactured by including tin in the electron material layer, and has improved electron emission and a long lifetime.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An oxide cathode comprising an electron emissive material layer including barium, a metal base, a sleeve and a heater, wherein said electron emissive material layer further comprises 0.1 to 20 wt. % of a member selected from the group consisting of tin and tin compounds, based on the total amount of the electron emissive material, and a member of the group consisting of indium and indium compounds.

2. An oxide cathode as claimed in claim 1, wherein said tin compound is at least one selected from the group consisting of tin carbonate, tin oxide, tin hydroxide and an organic compound of tin.

3. An oxide cathode as claimed in claim 1, said electron emissive material layer further comprising a complex compound of tin and indium.

4. An oxide cathode as claimed in claim 3, wherein said complex compound of tin and indium is indium-tin oxide.

5. An oxide cathode as claimed in claim 4, wherein said complex compound of tin and indium consists of, by weight, about 95% $In_2O_3$ and about 5% $SnO_2$.

6. An oxide cathode as claimed in claim 1, said electron emissive material layer further comprising an alloy of tin and indium.

7. An oxide cathode of claim 1, further including an oxide of at least one of Ca and Sr.

8. An oxide cathode of claim 7, further including an alloy of tin and indium.

9. An oxide cathode comprising an electron emissive material layer including barium, a metal base, a sleeve and a heater, wherein said electron emissive material layer further comprises 0.1 to 20 wt. %, based on the total amount of the electron emissive material, of a member selected from the group consisting of tin and tin compound, said tin compound being at least one selected from the group consisting of tin carbonate, tin oxide, tin hydroxide and an organic compound of tin.

10. An oxide cathode comprising an electron emissive material layer including barium, a metal base, a sleeve and a heater, wherein said electron emissive material layer further comprises 0.1 to 20 wt. %, based on the total amount of the electron emissive material, of a member selected from the group consisting of tin and tin compound, said electron emissive material layer further comprising a complex compound of tin and indium.

11. An oxide cathode as claimed in claim 10, wherein said complex compound of tin and indium is indium-tin oxide.

12. An oxide cathode as claimed in claim 11, wherein said complex compound of tin and indium consists of, by weight, about 95% $In_2O_3$ and about 5% $SnO_2$.

13. An oxide cathode comprising an electron emissive material layer including barium, a metal base, a sleeve and a heater, wherein said electron emissive material layer further comprises 0.1 to 20 wt. %, based on the total amount of the electron emissive material, of a member selected from the group consisting of tin and tin compound, said electron emissive material layer further comprising an alloy of tin and indium.

* * * * *